US005386931A

United States Patent [19]

Jacobsen et al.

[11] Patent Number: 5,386,931

[45] Date of Patent: Feb. 7, 1995

[54] MATERIAL DISPENSING TOOL FOR TUBULAR CARTRIDGES

[76] Inventors: Kenneth H. Jacobsen, 921 N. Quentin Rd., Palatine, Ill. 60067; Louis F. Cole, 672 Constitution Dr., Unit 93-5, Palatine, Ill. 60074

[21] Appl. No.: 155,425

[22] Filed: Nov. 19, 1993

[51] Int. Cl.[6] ..... B67D 5/42

[52] U.S. Cl. ..... 222/327; 222/391

[58] Field of Search ..... 222/137, 135, 136, 153, 222/326, 327, 391, 145

[56] References Cited

U.S. PATENT DOCUMENTS

| | | | |
|---|---|---|---|
| 2,731,176 | 1/1956 | Crewe | 222/326 |
| 2,786,604 | 3/1957 | Collins | 222/391 |
| 3,311,265 | 3/1967 | Creighton, Jr. et al. | 222/391 |
| 4,706,853 | 11/1987 | Stonesifer et al. | 222/327 |
| 5,156,305 | 10/1992 | Eyre | 222/327 |
| 5,263,614 | 11/1993 | Jacobsen et al. | 222/137 |

*Primary Examiner*—Andres Kashnikow
*Assistant Examiner*—Philippe Derakshani
*Attorney, Agent, or Firm*—Charles F. Lind

[57] ABSTRACT

A material dispensing tool has restraining and rear walls spaced apart to receive a material cartridge therebetween, and has an elongated rod supporting a plunger for movement between the walls and within the cartridge. A power ratchet mounted rearwardly of the rear wall over the elongated rod incrementally moves the elongated rod. Linkage including a spring concentrically arranged on the elongated rod effectively couples the power ratchet relative to the restraining wall, whereby the elongated rod can be resiliently biased by the strained spring. Output movement of the elongated rod relative to the power ratchet can thus be substantially independently of the plunger movement relative to the cartridge, the strained spring generating nearly uniform resilient plunger forces to discharge material from the cartridge.

8 Claims, 2 Drawing Sheets

MATERIAL DISPENSING TOOL FOR TUBULAR CARTRIDGES

RELATED APPLICATION

This is an improvement and/or modification of our copending application filed May 14, 1992 having Ser. No. 07/882,836, and entitled MATERIAL DISPENSING TOOL FOR TUBULAR CARTRIDGES; which issued as U.S. Pat. No. 5,263,614 on Nov. 23, 1993.

FIELD OF THE INVENTION

This invention relates to tools for dispensing substantially incompressible material contained in cartidges, and particularly tools of the type operated by an incrementally actuated power device.

BACKGROUND OF THE INVENTION

Caulk, adhesive, potting material and other fluids are commonly contained in tubular cartridges of the type having a closure wall and nozzle at one end and an opposite open end that is closed by a wiper slidably seated against the inside of the cartridge. Dispensing tools are available to hold these cartridges, and to move a plunger axially of and into the open cartridge end and against the wiper, for discharging the contained material from the open nozzle. Available dispensing tools can be powered pneumatically or manually. Although pneumatic tools generally outperform manual tools, manual tools are yet in demand because of advantages including costs and portability compared to pneumatic tools.

Most manual dispensing tools utilize a rod connected to the plunger and a power device, such as a ratchet mechanism activated by squeezing a trigger, that incrementally indexes the rod and its connected plunger axially of the cartrigde and toward the nozzle. A user's needed strength and experienced fatigue, and poor continuity of material flow, are major shortcomings of using the broadly described manual dispensing tools.

For example, most contained materials are substantially incompressible liquids or pastes having poor flow characteristics and/or high viscosities, and frequently the material must be discharged against a significant back pressure. Thus, large axial forces must be exerted on the plunger rod to advance the plunger through the cartridge. It is possible to use different ratio ratchet mechanisms to generate greater indexing forces, but as the indexed distance and generated force will be inversely related, a major drawback against user acceptance may be the additional number of squeezes needed to provide the intended volume of material discharge.

Moreover, with substantially incompressible liquids or pastes, the plunger advance must correspond exactly to the needed rate of material discharge. Each squeezing stroke ideally would take place over a short duration, within a second or so. However, such rapid completion of a squeezing stroke could advance the plunger significantly more than needed to provide the intended material discharge rate. Consequently, it has been necessary with an indexing power device, to extend each squeezing stroke over a longer continuous duration, in order to obtain the intended material discharge rate. When large squeezing pressures are also needed approaching even the user's maximum strength, cramped muscles are commonplace when the user must maintain such squeezing pressures continuously, squeeze after squeeze.

The above factors contribute to poor continuity of material flow, where rest pauses in the manual powering effort would typically result in a pulsed material discharge. However, even though a user conscientiously tries to produce a uniform material discharge against a high back pressure, during that brief pause between each trigger squeeze, the material discharge will virtual stop to yield a pulsed discharge.

These shortcomings are intensified when the dispensing tool and/or intended discharge point must be inconveniently located relative to the user, such as when making upwardly directed material discharges or when reaching excessively.

Moreover, composite materials having very desirable physical properties frequently can be formed by blending together reactive materials according to precise proportions. Common multiple component reactive materials include two-part epoxies, urethanes, silicones, phenolics, acrylics and polyesters. Existing manual dispensing tools for such multiple component material systems utilize a separate cartridge for containing each component, and force all component discharges through a single mixing nozzle for yielding a single combined material discharge. The separate cartridges are held in adjacent side-by-side relationship, and separate plungers are advanced in unison through the respective cartridges. As the components and their ratios can be varied to yield different materials, component cartridges are available in different sizes and diameters.

The forced blending of the components before discharge increases the needed static pressures and plunger forces, as does the possible use of large diameter cartridges for yielding large volumetric capacities and/or specific component ratios. Any variation from precisely matched advances of the paired plungers could modify the desired component ratios and adversely change the expected physical properties of the resulting material. Moreover, pulsed discharge disrupts proper component mixing and/or proportioning, resulting in inconsistent material discharge possibly having unexpected inferior physical properties.

SUMMARY OF THE INVENTION

Our above-mentioned copending application and U.S. Pat. No. 5,263,614 illustrated several manual dispensing tools having multiple plungers for multiple component fluid systems, and spring linkage between the power device and driven plungers for storing and dissipating unused energy inputted to the power device for maintaining substantially continuous forces on the plungers even between successive trigger squeezes. These tools overcame or minimized the above mentioned problems of user fatigue or needed strength, and poor continuity and/or mixing of material flow and discharge.

This invention relates to and a basic object of this invention is to provide dispensing tool designs having a spring linkage connection between the power device and driven plunger(s), suited for use on single or multiple component cartridge systems.

The invention teaches a spring linkage between the power device and driven plunger for storing and dissipating unused energy inputted to the power device for maintaining substantially continuous forces on the plunger even between successive trigger squeezes, and can be used on a single or multiple cartridge style dispensing tool.

A related object of this invention is to provide a manual dispensing tool suited for generating high static pressures and large plunger forces, while yet having a spring linkage between the power device and driven plunger for storing and dissipating unused energy inputted to the power device for maintaining substantially continuous forces on the plunger even between successive trigger squeezes and at high plunger forces and static dispensing pressures.

A specific feature of the dispensing tool relates to having the power device and spring linkage connection each generally located to act only axially and concentrically of the plunger/drive rod effective to minimize nonsymmetrical or canting forces tending to bend the tool or twist the cartridge wiper that might induce material leakage past the wiper. The spring linkage and power device connection is suited for use on a single cartridge system or by using a slave connection off of the driven plunger is also suited for use on multiple component cartridge systems. The strained spring linkage effectively located between the power device and the cartridge when strained will automatically store any energy inputted to the power device that cannot be used immediately in moving the plunger through the cartridge, to allow continuous dispensing pressures and nonpulsed material discharges even during pauses between power strokes and at high plunger forces and dispensing pressures.

BRIEF DISCRIPTION OF THE DRAWINGS

Further objects, advantages and features of the present invention will appear from the following disclosure and description, including as a part thereof the accompanying drawing, in which.

DETAILED DESCRIPTION OF ILLUSTRATED EMBODIMENTS

The dispensing tools 110 and 210 illustrated herein are respectively designed to hold two and one material cartridges, and to power a plunger into each cartridge for discharging the contained material as needed. The illustrations show that the invention will work with either a single plunger or a dual plunger dispensing tool.

The teaching of our above-mentioned copending application and U.S. Pat. No. 5,263,614 is incorporated by reference herein, to illustrate in greater detail the actual constructions of related component not shown in detail in this disclosure.

Figure 1:
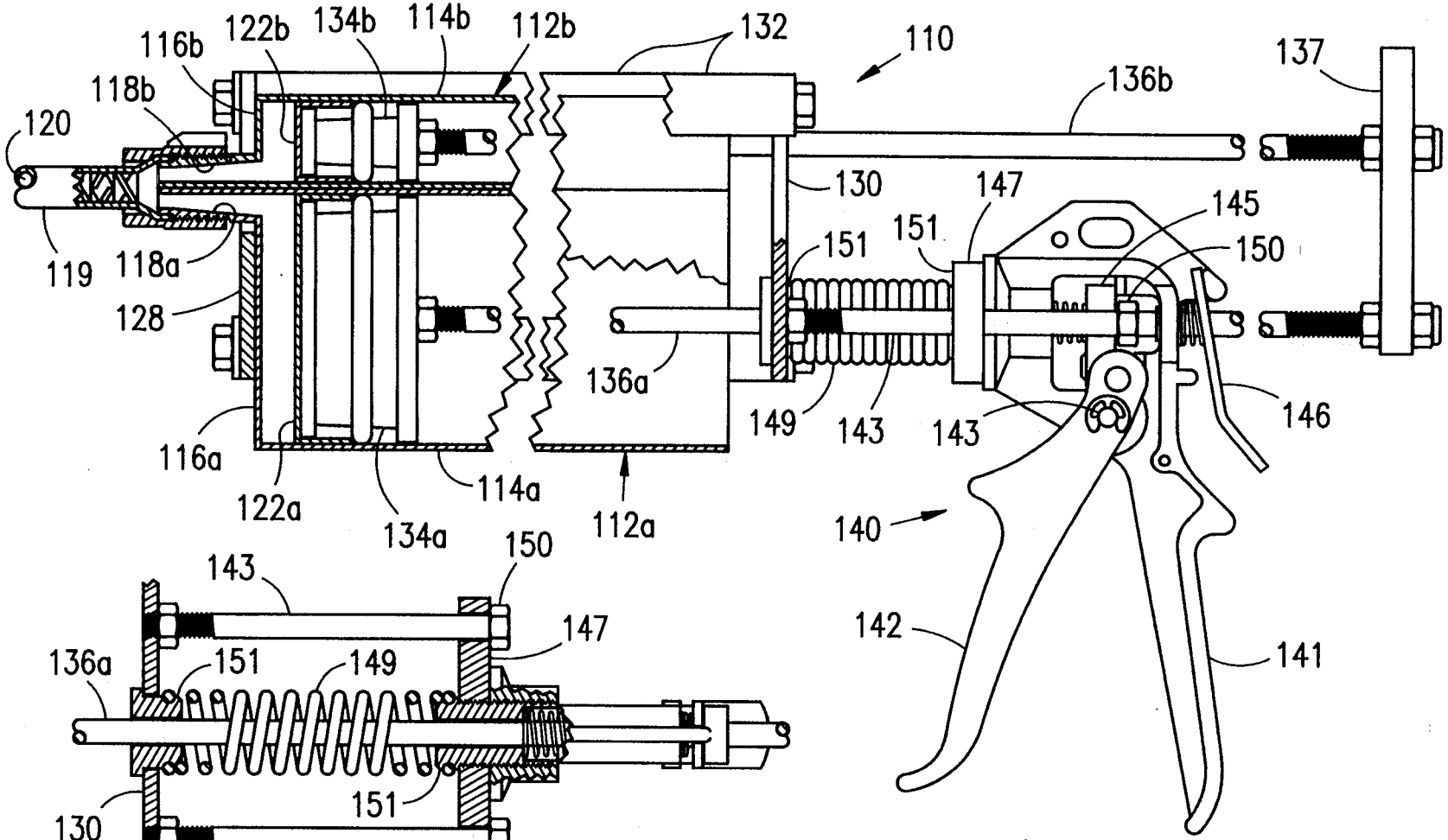
FIG. 1 is a side elevational view, partly broken away and in section for clarity of disclosure, of a first embodiment of dispensing tool, illustrating also a pair of material cartridges therein.
Figure 2:
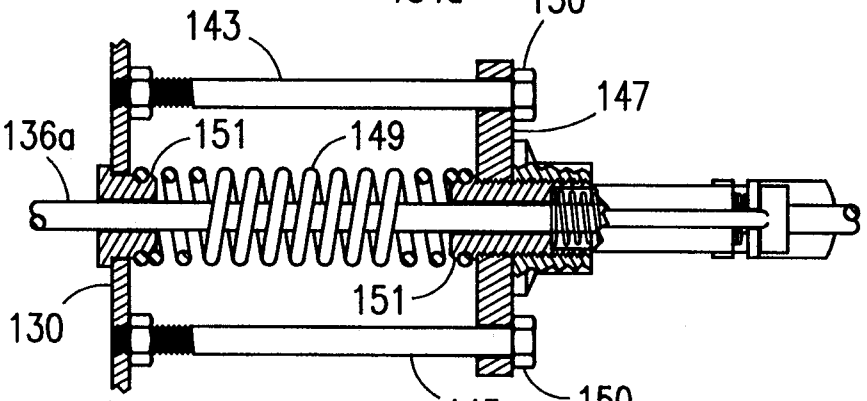
FIG. 2 is a top plan view, partly broken away and in section for clarity of disclosure, of part of the tool of FIG. 1, except showing the components in another operative position.

In the multiple component material system illustrated in FIGS. 1 and 2, the dispensing tool 110 is suited to hold two cartridges 112*a* and 112*b* each containing a different material, where the materials would have to be mixed together before being discharged as the intended final composite material. Each material cartridge would having a tubular body wall 114*a*, 114*b* with a closure wall 116*a*, 116*b* and tubular nozzle 118*a*, 118*b* at one end and an open opposite end closed by a wiper 122*a*, 122*b* seated against the inside face of the body wall and axially slidable within the cartridge. The cartridges 112*a* and 112*b* would be disposed side by side with the tubular nozzles being near the adjacent tangential edges of the cartridges and discharge from the cartridges would be forced through a single mixing tube 119 to be discharged as the composite new material from a single outlet nozzle 120.

The dispensing tool 110 has a front restraining wall 128 and a rear wall 130, and spaced axial members 132 connected rigidly between these walls. The tool walls 128,130 and members 132 are separated sufficiently to allow the material cartridges to be positioned therebetween, the cartridge closure walls 116*a*, 116*b* being against the restraining wall 128 and the nozzles 118 fitting through a slotted opening in the restraining wall.

Thus, in the dispensing tool 100 illustrated in FIGS. 1 and 2, two material cartridges 112*a*, 112*b* are used, each having a tubular body wall 114*a*, 114*b* with a closure wall 116*a*, 116*b* and tubular nozzle 118*a*, 118*b* at one end and an open opposite end closed by a wiper 122*a*, 122*b* seated against the inside face of the body wall and axially slidable within the cartridge.

Tool plungers 134*a*, 134*b* are carried on elongated rod 136*a*, 136*b* supported slidably by guides in openings in the rear wall 130, extending forwardly and rearwardly of the wall. The rear ends of the plunger rods are connected together by link 137, so that they can be moved axially only in unison substantially between the spaced walls 128, 130. The plungers and rods are concentric of and sized to fit within the respective cartridges and against the wipers therein.

A conventional power ratchet device 140 is mounted over the plunger rod 136*a* rearwardly of the rear wall 130. The ratchet device 140 has a stationary frame including handle 141 and trigger 142 pivoted thereto on pin 143. A drive member 145 is coupled to the trigger 142. The plunger rod 136*a* fits through the ratchet device, cooperating with drive member 145 and lock member 146, being spring biased thereagainst, to drive the rod axially responsive to the actuation of the trigger. The power device 140 is connected to a cross member or wall 147, also located rearwardly of the rear wall 130.

A coil extension spring 149 is located concentrically of and around the rod 136*a*, and has its ends located against and axially connected at bracket 151 relative to the rear wall 130 and cross member 147. In its relaxed condition, the adjacent spring coils are against one another in a solid or bottomed configuration. Being axially connected at its ends relative to the rear wall 130 and cross wall or member 147, the relaxed extension spring 149 thus normally holds these components in the closest position relative to one another as illustrated in FIG. 1.

Bolts 143 are secured relative to the rear wall 130 and fitted loosely through openings in the cross wall 147, the bolt heads 150 at the opposite ends serving as stops when butted thereagainst (see FIG. 2) for determining the maximum separation of these walls. As noted, the coil extension spring 149 is sized to draw these walls 130, 147 together until the spring turns bottom against one another, determining the opposite closest limit of movement of the walls 130, 147 relative to one another. It is apparent that to move the wall components to their maximum separation (when the bolt heads 150 are drawn against the cross wall 147), the spring must be additionally strained or extended from the condition of FIG. 1.

Figure 3:
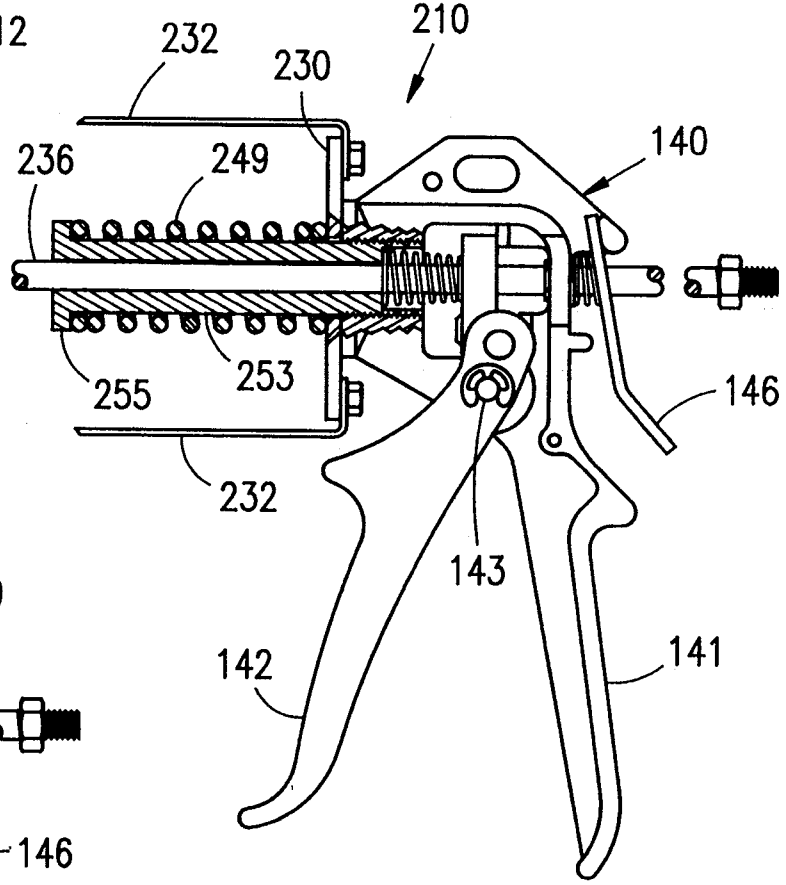
FIG. 3 is a side elevational view, partly broken away and in section for clarity of disclosure, of a second embodiment of dispensing tool.
Figure 4:
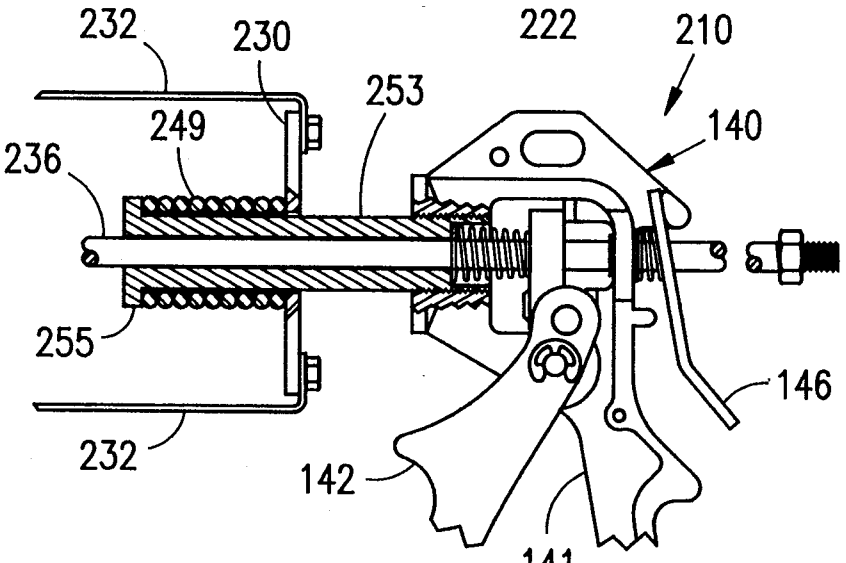
FIG. 4 is a top plan view, partly broken away and in section for clarity of disclosure, of part of the tool of FIG. 3, except showing the components in another operative position.

The dispensing tool 210 illustrated in FIGS. 3 and 4 is for a single cartridge 212, and has front restraining wall 228, rear wall 230 and spaced axial members 232 connected rigidly between these walls, all properly spaced apart to allow the material cartridge to be positioned therebetween. The cartridge closure wall 216 butts against the front restraining wall 228, with its nozzle 218 fitted through a slotted opening in the wall. A wiper 222 fits in and closes the otherwise open rear end of the cartridge.

A plunger 234 is carried on elongated rod 236, being sized to fit into the open cartridge end and against the wiper 222. The rod 236 is slidably guided through an opening in the rear wall 230 and extends rearwardly beyond the rear wall. A conventional power ratchet device 140 is located rearwardly of the rear wall 230, having a stationary handle 141, movable trigger 142 pivoted thereto on pin 143. The plunger rod 236 fits through the ratchet device, where drive member 145 and lock member 146 releasably engage it, being spring biased thereagainst, and the drive member 145 further being coupled to the trigger 142.

A sleeve 253 is secured to the power device 140, having a bore slidably receiving the drive rod 236 and fitting axially slidably within an opening in the rear wall 230. A flange 255 is formed on the sleeve 253, on the side of the rear wall 230 remote from the power device. A coil compression spring 249 is located on the sleeve 253, trapped between the flange 255 and the rear wall 230. The coil spring 249 is concentrically located relative to the sleeve and the interiorly sliding drive rod 236.

The coil spring 249 is sized to allow relative movement of the power device toward and away from the rear wall, between its opposite minimum and maximum separation positions. Thus, in the closest or minimum separation relative position, the spring is extended to its most relaxed condition and the power device 140 is bottomed against the rear wall 230. In its furthest or maximum separation relative position, the spring is bottomed on itself to its most strained condition and the power device 140 spaced rearwardly from the rear wall 230. It is apparent that to move the power device to its maximum separation from the rear wall 230 (FIG. 4), the spring 249 must be additionally strained or compressed from the condition of FIG. 3.

The illustrated dispensing tools 110 and 210 each provide a common drive-plunger rod and a spring linkage between the actuated power device and driven plunger and the cartridge restraining wall 128. 228, and the spring 149, 249 is supported concentrically on the drive or plunger rod **136*a*, 236. Thus, the tools are specifically suited for generating large forces on the drive/plunger rods 136*a* and 236, as the coupling spring linkage is concentrically aligned with the cartridge and drive rod, minimizing any couple or distorting force that might tend to bend the tool itself or twist the wiper out of square within the cartridge to induce material leakage past the wiper. Moreover, the spring is located proximate the rear wall 130, 230**, minimizing the distance of the couple arm between the drive force applied to the cartridge plunger.

The contained material is flowable, as a paste or liquid, but generally is incompressible. The cross-section and length of the nozzles (compared to the cross-section of each cartridge and wiper) and the viscosity of each contained material influence the resistance against material discharge, and the pressure buildup needed within the cartridge to provide material discharge must exceed this resistance and the actual discharge pressure. Should sufficient back pressure be present, it is possible to preclude all plunger movement in the cartridge and all drive rod advance through the power device. More commonly though, should greater back pressure be present than the driving force of the spring linkage, the plunger advance in the cartridge and the drive rod advance through the power device could no longer be in unison.

Specifically, squeezing the trigger 142 toward frame handle 141 axially and incrementally indexes the drive rod **136*a*, 236 forwardly relative to the power device and toward the restraining wall 128, 228, and it carries with it the connected plunger 134*a* (and plunger 134*b*), 234. The lock member 146 in the illustrated position holds the drive rod 136*a*, 236 as forwardly shifted, even when the squeezed trigger 142** is released to its illustrated position, allowing the trigger to be released for a subsequent stroke.

Repeated activation of the trigger 142 will continue to forward index the drive rod relative to the power device, the rapidity of trigger activation determining the rate of drive rod advance. However, should the resistance against simultaneous plunger-cartridge movement exceeds the spring force holding power device at its at minimum strain position relative to the rear wall (FIGS. 1 and 3), the minimum spring strain stops will become gapped apart. The drive linkage then becomes resilient, the spring 149, 249 thereafter solely causing plunger-cartridge movement and resulting material discharge.

Further repeated trigger activation will continue to index the drive rod **136*a*, 236, which movement will be shared between actual plunger-cartridge movement and power device-rear wall gap increase (or decrease) resulting in increased (or decreased) spring forces. This resilient driving action can continue during the entire use of the dispensing tool, until too slow trigger activation will allow the minimum strain stops to bottom or too fast trigger activation will cause the maximum spring strain stops to bottom (FIGS. 2 and 4) by either the bolt heads 150 striking the frame 147 or the spring 249** bottoming on itself.

Bottoming of the maximum spring strain stops (FIGS. 2 and 4) establishes a solid drive linkage similar to a conventional solid drive power indexed tool, whereby repeated trigger activation is then possible only at the rate allowed to provide in unison drive rod-power device and plunger-cartridge movements. The maximum spring force occurs just when the maximum spring strain stops (FIGS. 2 and 4) are bottomed.

The spring linkage effectively couples the power device 140 and material cartridge(s) **112*a* and 112*b*, 212 relative to one another, by the power device being resiliently mounted relative to the rear wall 130, 230 which is unitary with the restraining wall 128, 228** which directly contacts the carriage(s).

The spring and its effective stroke and minimum and maximum generated forces will be selected to maintain sufficient forces in the minimum strained position to provide material discharge under most intended operating conditions. The resilient dynamic plunger force generated when both the maximum and minimum spring strain stops are gapped provides a reasonably constant and uniform material discharge at an intended reliable rate, notwithstanding pauses between trigger activation or the like.

Although the difference between the maximum and minimum spring forces of the resilient stroke might be substantial, incremental force changes would vary little and the spring force would be continuous, even during the pauses between trigger squeezes. With the illustrated conventional springs, the dynamic spring force would vary linearly with spring displacement. Different type(s) of spring(s) could be used to have the dynamic spring force versus displacement vary in a nonlinear manner, progressively or stepped.

The continuously and resiliently driven plungers provide nearly uniform and continuous material discharge, which is particularly effective and needed in a multiple component materials system.

The disclosed spring linkage also makes the dispensing tool easier and more effective to use. For example, each trigger squeeze will be resisted by only the known dynamic spring force, and can be completed quickly. By contrast, each trigger squeeze of a solid drive linkage dispensing tool can only be completed as rapidly as the actual plunger-cartridge movement, with the additional uncertainities of squeezing pressures and duration.

Movement of the lower free end of lock member 146 toward handle 141 would release the drive rod, should such be intended or needed, allowing then the rapid rearward movement relative to the device frame away from the restraining wall 128, 228 and a corresponding drop in contained static material pressures in the cartridge.

The inventive design can be easily incorported into existing conventional dispensing tools, merely by modifying such by utilizing the movement limiting bolts or sleeve, the spring, and longer frame connecting members and plunger rods. Also, either drive version, with the spring in front of or to the rear of the rear frame wall 130, 230 can be used with either a single or multiple component dispensing tool, and not just as illustrated.

Thus, it is apparent that incidental variations of the invention can be made without departing from the inventive concept, so that the invention should be limited only by the scope of the following claims.

What is claimed as our invention is:

1. A tool for dispensing material from a cartridge having a tubular body with a closure wall and nozzle at one end and an open opposite end closed by a wiper slidable within the tubular body, comprising the combination of restraining and rear walls spaced apart to receive the cartridge therebetween with the closure wall against the restraining wall, a plunger sized to fit within the open end of the cartridge and against the wiper, and an elongated rod projecting forwardly and rearwardly beyond the rear wall for supporting the plunger for movement generally between the restraining and rear walls;

power means having a frame and means to manually actuate the power means including a trigger movable relative to the frame and including said elongated rod being moved incrementally relative to the frame responsive to actuation of said trigger;

linkage means coupling the power means frame and restraining wall relative to one another, said linkage means including spaced respective maximum and minimum stops effective to limit the possible movement of the power means frame and restraining wall relative to one another between respective maximum and minimum positions of relative separation, and a spring concentrically arranged on the elongated rod operable to bias these components relative to one another, said spring being strained its minimum when the minimum stops are bottomed and being strained its maximum when the maximum stops are bottomed; and the linkage means allowing output movement of the elongated rod relative to the power means substantially independently of the plunger movement relative to the cartridge, and providing resilient dynamic force conditions when the neither set of stops is bottomed; and the spring generating sufficient resilient dynamic forces to move the plunger forwardly within the cartridge for discharging the material from the cartridge nozzle.

2. A dispensing tool according to claim 1, further providing said linkage means coupling including means to support the power means frame relative to the rear wall.

3. A dispensing tool according to claim 1, further providing said spring being concentrically arranged on the elongated rod at a location forwardly of the rear wall.

4. A dispensing tool according to claim 3, further comprising a sleeve over elongated rod arranged forwardly of the rear wall and connected at it rear end directly to said rear wall, and said spring being trapped between the forward end of the sleeve and said rear wall.

5. A dispensing tool according to claim 1, further providing said spring being concentrically arranged on the elongated rod rearwardly of the rear wall.

6. A dispensing tool according to claim 5, further comprising means connecting the forward end of the spring relative to said rear wall and means connecting the rearward end of the spring relative to said power device frame.

7. A dispensing tool according to claim 6, further comprising the spring being an extension type.

8. A tool for dispensing material from a cartridge having a tubular body with a closure wall and nozzle at one end and an open opposite end closed by a wiper slidable within the tubular body, comprising the combination of restraining and rear walls spaced apart to receive the cartridge therebetween with the closure wall against the restraining wall, a plunger sized to fit within the open end of the cartridge and against the wiper, and an elongated rod projecting forwardly and rearwardly beyond the rear wall for supporting the plunger for movement generally between the restraining and rear walls;

power means having a frame and means for mounting the power means frame rearwardly of the rear wall and over the elongated rod and means to manually actuate the power means including a trigger movable relative to the frame and said elongated rod being moved incrementally relative to the frame responsive to actuation of said trigger;

linkage means including a spring concentrically arranged on the elongated rod effectively coupling the power means frame and restraining wall relative to one another and allowing possible movement of the elongated rod relative to said power means incident to said spring being strained between respective minimum and maximum strained conditions and thereby generating a resilient force between the elongated rod and restraining wall; and the linkage means allowing output movement of the elongated rod relative to the power means frame substantially independently of the plunger movement relative to the cartridge, corresponding to and upon said spring being strained between its minimum and maximum strained conditions, and the strained spring generating sufficient resilient forces to move the plunger forwardly within the cartridge for discharging the material from the cartridge nozzle.

* * * * *